US005129339A

United States Patent [19]

Dietl

[11] Patent Number: 5,129,339

[45] Date of Patent: Jul. 14, 1992

[54] BLIND-STITCH SEWING MACHINE

[75] Inventor: Rudolf Dietl, Munich, Fed. Rep. of Germany

[73] Assignee: J. Strobel & Sohne GmbH & Co., Munich, Fed. Rep. of Germany

[21] Appl. No.: 739,664

[22] Filed: Aug. 2, 1991

[30] Foreign Application Priority Data

Aug. 3, 1990 [DE] Fed. Rep. of Germany ..... 4024715

[51] Int. Cl.[5] ..... D05B 1/24

[52] U.S. Cl. ..... 112/178

[58] Field of Search ..... 112/176, 177, 178, 267.1

[56] References Cited

U.S. PATENT DOCUMENTS

| | | | |
|---|---|---|---|
| 2,194,149 | 8/1937 | Mueller | 112/178 |
| 2,250,573 | 7/1941 | Dearborn | 112/178 |
| 2,355,904 | 8/1944 | Buono | 112/178 |
| 3,747,546 | 7/1973 | Jurgens | 112/178 |
| 4,184,442 | 1/1980 | Maier | 112/178 |

FOREIGN PATENT DOCUMENTS

| | | |
|---|---|---|
| 2037502 | 2/1972 | Fed. Rep. of Germany . |
| 9134 | of 1916 | United Kingdom . |
| 727340 | 3/1955 | United Kingdom . |
| 1331476 | 9/1973 | United Kingdom . |
| 2119415 | 11/1983 | United Kingdom . |
| 2187212 | 9/1987 | United Kingdom . |

*Primary Examiner*—Werner H. Schroeder
*Assistant Examiner*—Paul C. Lewis
*Attorney, Agent, or Firm*—Bacon & Thomas

[57] ABSTRACT

The invention pertains to a blind-stitch sewing machine with a plate-shaped fabric bender to make a sewing material bulge in to the arcuate path of an arc needle. The fabric bender extends in a plane perpendicular to the path of the arc needle and is pivotable to-and-fro in this plane by means of a drive shaft extending perpendicular to this plane. The fabric bender is rotatably supported in a slot of a support assembly projecting from the drive shaft to pivot about an axis parallel to this drive shaft, and furthermore is spring biased away from the drive shaft. To achieve a narrow construction of the fabric bender and of its support assembly, the drive shaft is hollow and a torsion spring is provided to load the fabric bender. The torsion spring is mounted in the borehole of the hollow shaft where adequate space is available to install the spring.

21 Claims, 4 Drawing Sheets

BLIND-STITCH SEWING MACHINE

BACKGROUND OF THE INVENTION

The invention concerns a blind-stitch sewing machine having a fabric bender to bulge the material to be sewn into the arcuate path of a sewing needle.

Such blind-stitching machines having plate-shaped fabric benders are known as represented by U.S. Pat. No. 2,355,904 and German Offenlegungsschrift 20 37 502. In these prior arrangements, the fabric bender is rotatably supported approximately at its center or at an end and is loaded by a tension or compression spring in a direction away from a solid drive shaft for the fabric bender. The drive shaft is rotatably supported in a fabric-support arm of the blind-stitching machine and during sewing pivots to-and-from in synchronization with the to-and-fro pivoting arc needle of the machine and with a correspondingly timed stepwise advance of the sewing material. The fabric bender is received in a slot of a support assembly projecting perpendicularly from the drive shaft, which slot extends transverse to the drive shaft in an end of the support assembly remote from the drive shaft.

The tension spring is extended between an end of the centrally supported fabric bender and an arm of the support assembly. This arm and the support assembly are radial to the drive shaft. The tension spring forces the fabric bender against the bottom of the slot in the support assembly. From this position the fabric bender can pivot against the force of the tension spring while its other end moves away from the path of the arc needle toward the drive shaft of the fabric bender. During sewing, when a thicker portion of the sewing material arrives near the fabric bender, a sewing-material sensor causes the pivoting of the fabric bender. The sewing-material sensor takes the form of a lateral stud secured to the other end of the fabric bender and contacts the sewing material on one side of the bulge formed therein by the fabric bender.

The compression spring is mounted in a longitudinal borehole of the support assembly and rests at one end on an adjustment screw threadable into the borehole to change the bias of the compression spring and at the other end through a ball on that end of the fabric bender which is remote from its pivot axis. To limit the range within which the fabric bender can be pivoted inside the slot, the support assembly comprises a stop pin extending transversely in the slot through an elongated and arcuate hole in the fabric bender that is concentric with the pivot axis of the fabric bender. The compression spring urges the fabric bender against the stop pin. The fabric bender can pivot from this position against the force of the compression spring until the other end of its elongated hole contacts the stop pin, the end of the fabric bender which is near the compression spring moving away from the path of the arc needle toward the drive shaft of the fabric bender. The fabric bender pivots to leave the first-stated position whenever, during sewing, a thicker sewing material portion arrives between the fabric bender and a stop at a throat plate of the blind-stitching machine. The fabric bender makes the sewing material bulge against the stop which is spring-loaded toward the sewing material so the stop will yield and move against the spring action by an amount which can be adjusted by means of an adjustment screw.

Moreover, blind-stitching machines are known having such a fabric bender urged by means of a compression spring into the normal position in a support assembly and cooperating with a stop similar to the one discussed above, and further comprising a second, also plate-shaped fabric bender pivoting to-and-fro which, however, is rigidly joined to its associated drive shaft and cooperates with a stop located at the throat plate of the blind-stitching machine which is spring-loaded toward the sewing material but not adjustable with respect to the amount of yielding. The two fabric benders are mounted next to each other and alternatingly make the sewing material bulge, each against the associated stop. This type of blind-stitching machine is described in U.S. Pat. No. 3,747,546.

In another known arrangement, as shown in U.K. Pat. No. 1,331,476, two bar-shaped fabric benders can be shifted axially to-and-fro by means of an associated drive shaft. Each fabric bender in this arrangement is elastically supported through a compression spring in a bushing connected to the drive shaft. The bias of the compression spring is adjustable by means of an adjustment screw. The drive shaft of one of the fabric benders is hollow and rotably supported on the drive shaft of the other fabric bender which, in turn, is rotatably supported in a fabric-support arm of the blind-stitching machine. This fabric-support arm is spring-loaded into the sewing position to abut a stop whose position can be adjusted by means of an adjustment screw through a linkage to change the distance between the fabric-support arm in the sewing position and the path of the blind-stitching machine arc needle, i.e. to adjust the stitch-depth of the arc needle in the sewing material made to bulge by the fabric benders. The two fabric benders make the sewing material bulge against a common stop mounted on a throat plate of the blind-stitching machine. The common stop is spring-biased toward the sewing material in order to be able to yield and to move against the spring action by an amount determined by the position of an adjustment screw.

SUMMARY OF THE INVENTION

The object of the invention is to provide a blind-stitch sewing machine in which the fabric bender and its support assembly can be extraordinarily narrow while enabling accommodation of an extremely level characteristic spring acting between the fabric bender and the support assembly. The arrangement also permits changing of the spring bias within an extraordinarily wide range and setting the bias at different values. The narrow design of the fabric bender and of the support assembly also makes it possible to mount sewing-material advance devices with a very short mutual spacing on both sides of the fabric bender and of the support assembly. By the present invention, it is also possible to add an additional fabric bender without entailing any substantial changes in the narrow assembly of the sewing-material advance devices.

Further advantages of the blind-stitching machine of the present invention will become apparent from the following detailed description of two embodiments illustrated in the following drawings.

DETAILED DESCRIPTION OF THE INVENTION

Figure 1:
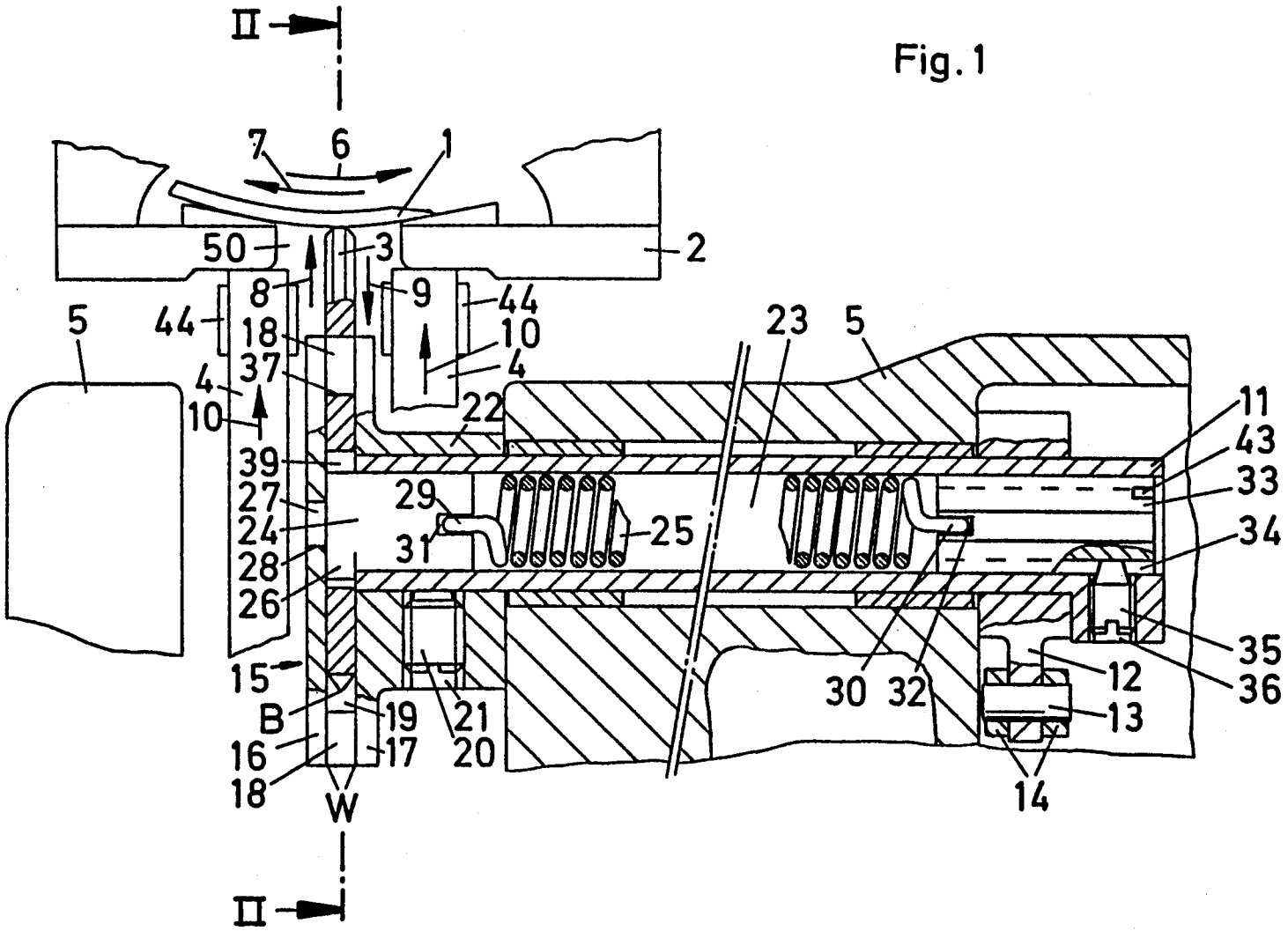
FIG. 1 is the front view of a blind-stitch sewing machine of the invention.
Figure 2:
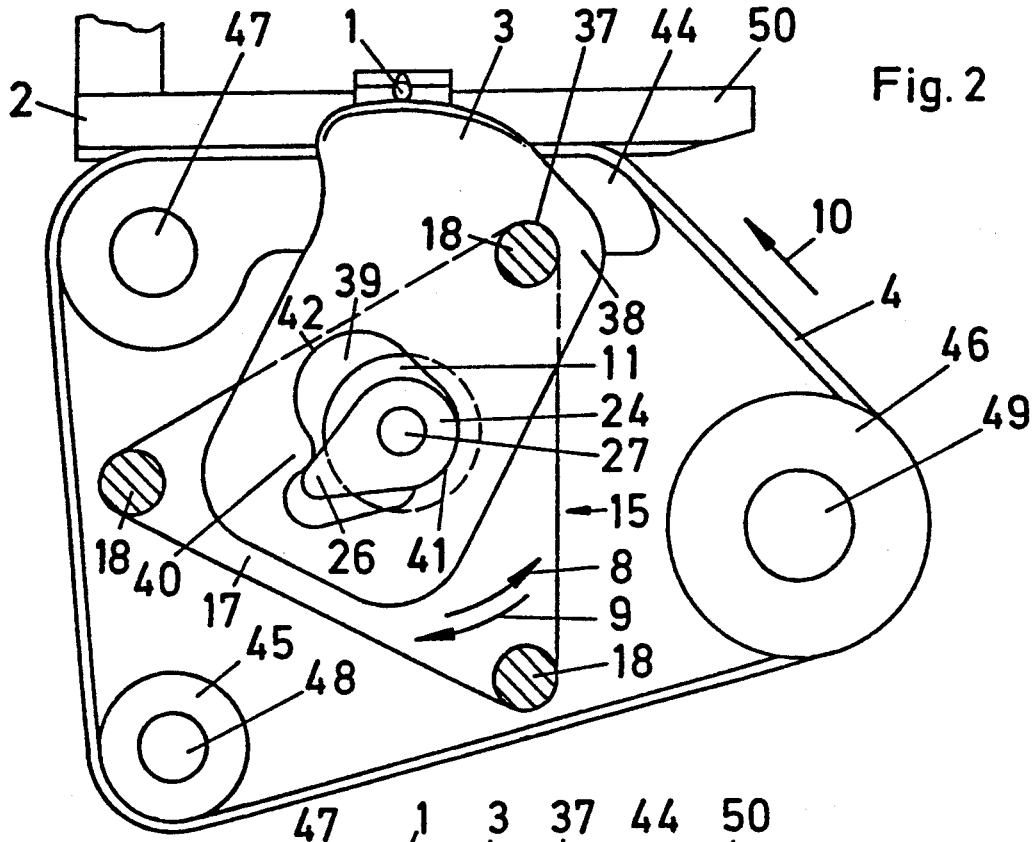
FIG. 2 is the section along the line II—II of FIG. 1.
Figure 3:
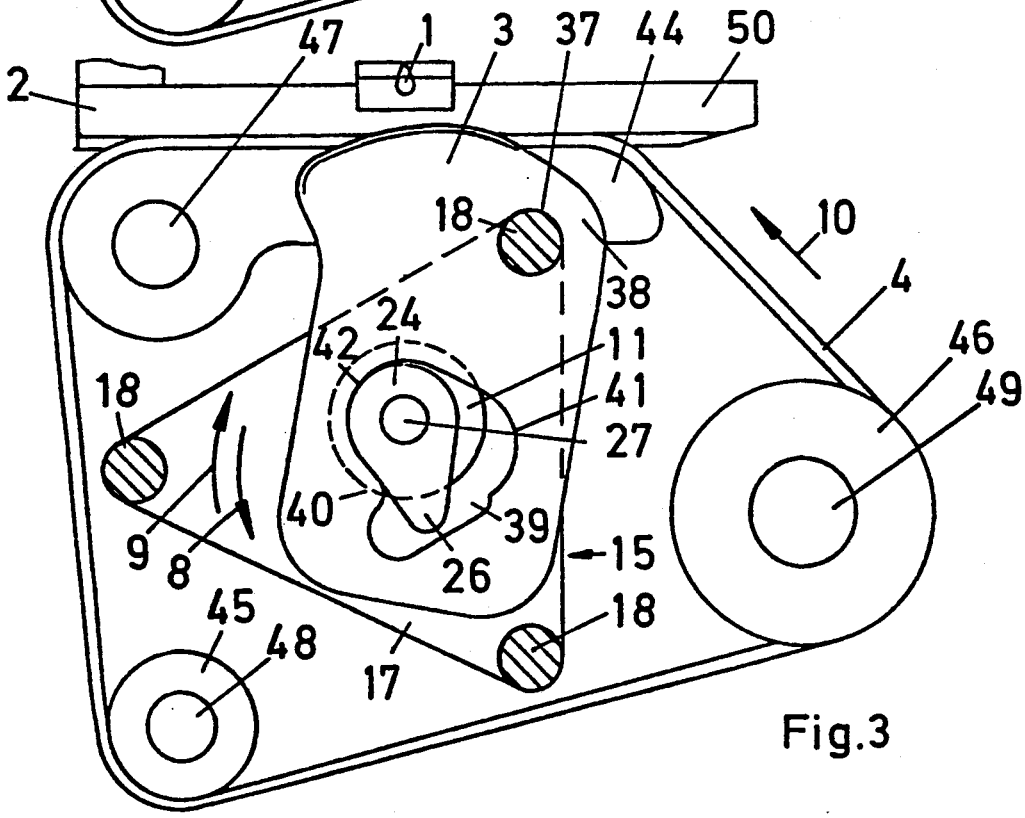
FIG. 3 is the same sectional view as in FIG. 2, but with the fabric bender of the present invention pivoted counterclockwise.

The blind-sttching machine shown in FIGS. 1 through 3 comprises an arc needle 1, a throat plate 2, a fabric bender 3 and two feed belts 4. The arc needle 1 and the throat plate 2 are mounted on the head of the blind-stitching machine, and the fabric bender 3 and the feed belts 4 are mounted on its fabric-support arm 5. During sewing, the arc needle 1 swings to-and-fro in the direction of the arrows 6 and 7, the fabric bender 3 oscillates in the direction of the arrows 8 and 9 and the feed belts 4 move stepwise in the direction of the arrows 10. The pivoting motion of the arc needle 1, the oscillation of the fabric bender 3 and the displacement steps of the feed belts 4 are synchronized in relation to one another, whereby the arc needle 1, the fabric bender 3 and the feed belts 4 act in the required sequence on a piece of material extending between the throat plate 2 and the feed belts 4.

The fabric bender 3 comprises a substantially rectangular plate and extends in a plane defined by the line II—II in FIG. 1, i.e., a plane perpendicular to the arcuate path of the arc needle 1. Fabric bender 3 is oscillated in this plane in the direction of the arrows 8 and 9 by means of a drive shaft 11 which extends perpendicular to this plane. The drive shaft 11 is rotatably supported in the fabric-support arm 5 and comprises an arm 12 at the end of shaft 11 remote from fabric bender 3. Arm 12 is linked by a bolt 13 to a bar 14 allowing pivoting of the drive shaft 11 to-and-fro by means of the arm 12 in the direction of the arrows 8 and 9. Fabric bender 3 is connected by a support assembly 15 to drive shaft 11.

Support assembly 15 for fabric bender 3 consists of two parallel plates 16 and 17 having substantially identical triangular contours and being connected by one bolt 18 at each of the three apices of the triangular contours. Plates 16 and 17 extend perpendicular to drive shaft 11 with which they are mounted concentrically. Due to this arrangement, the three bolts 18 extend parallel to drive shaft 11 and are approximately equal distances from it. The plates 16 and 17 define a slot 19 arranged to receive the plate-shaped fabric bender 3. The width W of slot 19 corresponds to the thickness B of fabric bender 3, and the slot 19 extends transversely in front of the adjacent end of drive shaft 11. Plate 17 of support assembly 15 is fastened to this end of drive shaft 11 by means of a clamping screw 20. Clamping screw 20 is threaded into a radial borehole 21 formed in a hub portion 22 of plate 17 and is tightened against drive shaft 11.

Drive shaft 11 is hollow and comprises a continuous borehole 23 in which a cylindrical pin 24 is rotatably supported and in which is disposed a torsion spring 25. Cylindrical pin 24 comprises, at one end, a radially projecting cam 26 which extends into slot 19 of support assembly 15 and an axially extending projection 27 of small diameter which is received in a borehole 28 of matching diameter in plate 16. Torsion spring 25 acts on the other end of the cylindrical pin 24 as will be more fully explained below.

Torsion spring 25 is a helical spring with two ends 29 and 30 arranged to extend transverse to the longitudinal axis of this helical spring. Each end is seated in a cross-slot 31 and 32 respectively formed in the adjacent end of pin 24 and in the adjacent end of a holder 33 (see FIGS. 1 and 4). Holder 33 is cylindrical and rotatably supported in borehole 23 of drive shaft 11 and comprises four circumferentially spaced, longitudinal grooves 34. A clamping screw 35, threaded into a radial borehole 36 of drive shaft 11, engages a longitudinal groove 34 and secures holder 33 in place relative to the drive shaft 11.

The fabric bender 3 is pivotably supported in slot 19 of support assembly 15 and is biased by torsion spring 25 through pin 24 in a direction away from drive shaft 11 and toward the path of arc needle 1. The bolt 18 of support assembly 15, which is adjacent to the throat plate 2 and which, upon rotation of the support assembly 15 in the direction of the arrow 8, moves toward throat plate 2, serves to support the fabric bender 3. This bolt 18 passes through a corresponding support borehole 37 formed in fabric bender 3 at that corner 38 thereof which is adjacent throat plate 2 and which is trailing when fabric bender 3 is pivoted by means of the drive shaft 11 through support assembly 15 in the direction of arrow 8, as best shown in FIGS. 2 and 3. Fabric bender 3 also comprises an aperture 39 receiving the cam 26 and the associated end of pin 24. The aperture 39 is shaped in such a way that a projection 40 and two stop edges 41 and 42 are present at the fabric bender 3, the functions of which will be described below.

Cam 26 of pin 24 cooperates with projection 40 of the fabric bender 3 to force the fabric bender 3, by means of the torsion spring 25, into the position shown in FIG. 2 relative to the support assembly 15. In this position, the stop edge 41 of fabric bender 3 abuts the cam-side end of the pin 24, and from this position, fabric bender 3 can pivot counterclockwise, namely against the action of the torsion spring 25 with corresponding rotation of cam 26 resting against projection 40 and rotation of pin 24 in borehole 23 of drive shaft 11 until arriving at the position of the fabric bender 3 shown in FIG. 3. In the FIG. 3 position, the stop edge 42 of the fabric bender 3 abuts the cam-side end of the pin 24. The two stop edges 41 and 42 of fabric bender 3 therefore set the range within which fabric bender 3 may pivot inside slot 19 of support assembly 15.

The force by which torsion spring 25 loads fabric bender 3 into the position shown in FIG. 2 relative to support assembly 15 can be adjusted. To set the desired bias of the torsion spring 25, clamping screw 35, which cooperates with holder 33 of the torsion spring 25 as previously discussed, is loosened in order to permit rotation of holder 33 by means of a screwdriver or other device inserted in a cross-slot 43 formed in holder 33 located at an end away from the torsion spring 25. The holder 33 can be rotated until another longitudinal groove 34 of the holder 33 is aligned with the clamping screw 35. Clamping screw 35 can then be tightened to engage longitudinal groove 34 and to fix the desired bias of torsion spring 25.

From the above discussion, it can be readily seen that the two feed belts 4 extend on both sides of and parallel to the plane defined by the line II—II of FIG. 1, the fabric bender 3 and its support assembly 15 can be pivoted to-and-fro by the drive shaft 11, and the fabric bender 3 can be pivoted relative to support assembly 15.

Figure 5:
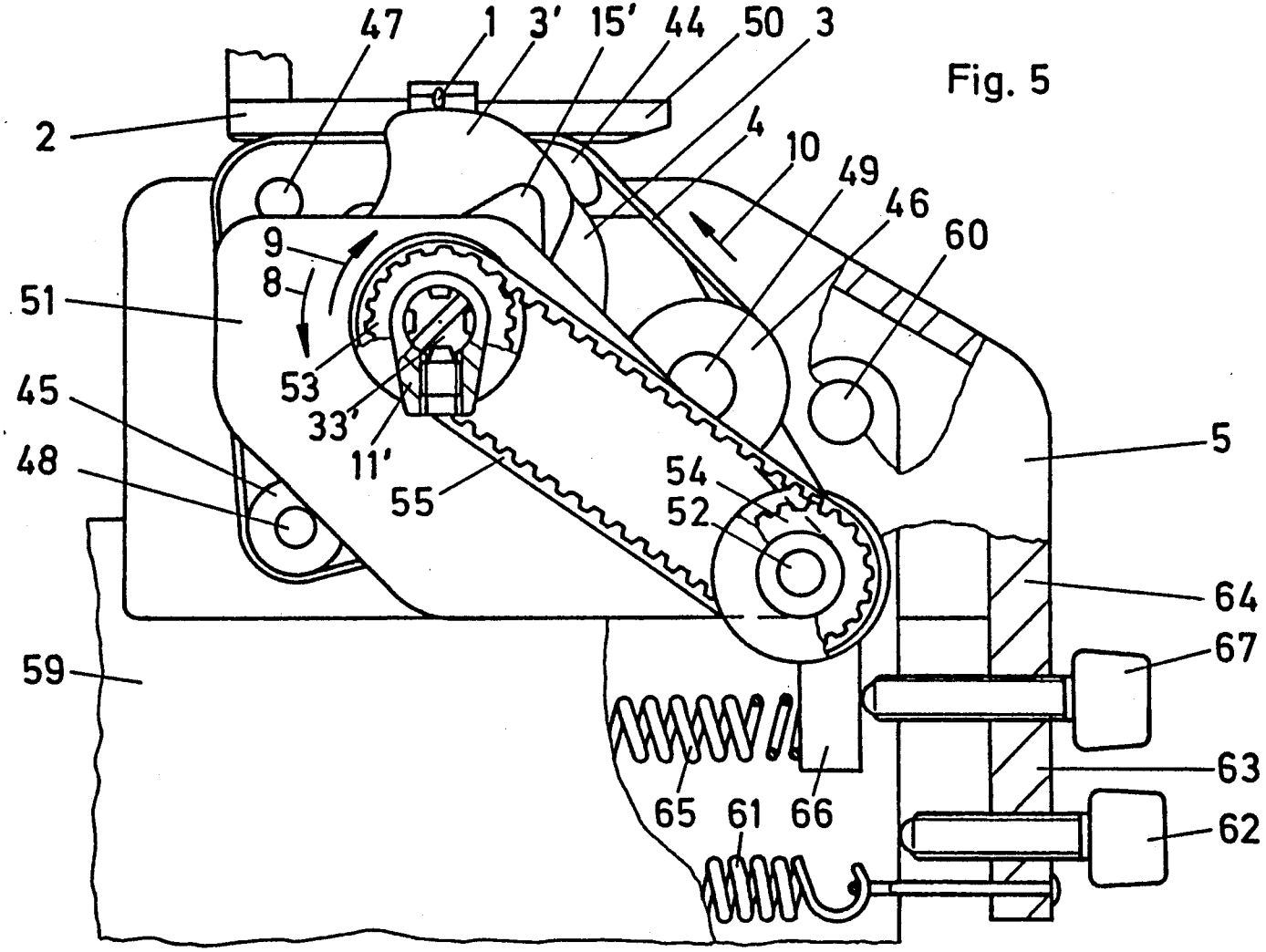
FIG. 5 is a side view of this blind-stitch sewing machine taken in the direction of arrow V of FIG. 4.

As best shown in FIG. 5, each endless feed belt 4 extends over a pressing lever 44, a guide wheel 45 and a drive wheel 46. The pressing lever 44 is pivotably supported at one end on a shaft 47 of the fabric-support arm 5 and is spring-biased toward throat plate 2. The guide wheel 45 is rotatably supported on a shaft 48 of the fabric-support arm 5. Each drive wheel 46 is affixed to a drive shaft 49 which itself is rotatably supported in the fabric-support arm 5. The two shafts 47 and 48 and also drive shaft 49 extend parallel to the drive shaft 11 of the fabric bender 3.

Because of the extraordinary narrowness of the fabric bender 3 and support assembly 15, the two feed belts 4 can be mounted very tightly against each other, so that their mutual spacing is very slight. In the preferred embodiment, the fabric bender 3 may have a thickness B of about 1.2 mm and the two plates 16 and 17 of support assembly 15 each may be about 0.8 mm thick.

During sewing, the feed belts 4 move the sewing material stepwise in the direction of the arrows 10 (FIGS. 1 and 4) and the fabric bender 3 makes the sewing material bulge, following each step of advance, through a slot 50 in the throat plate 2 and extending in the direction of advance 10 of the sewing material and thereupon the arc needle 1 enters the bulged sewing material. Depending upon the degree of bulge imparted by the fabric bender 3 to the sewing material beyond the arcuate path of the arc needle 1, i.e. depending on the thickness of the bulged sewing material and on the proximity to which the fabric bender 3 approaches the path of the arc needle 1 when being pivoted by the drive shaft 11 through the support assembly 15 in the direction of the arrow 8, the depth at which arc needle 1 will pierce the sewing material will vary. Since the gap between the two feed belts 4 pressing the sewing material on both sides of the fabric bender 3 by means of the pressing levers 44 against the throat plate 2 is comparatively narrow, the sewing material will be held in a reliable, consistent manner throughout the sewing operation.

In order to set the depth of penetration of the arc needle 1 into the sewing material bulged by the fabric bender 3, fabric-support arm 5 is adjustable relative to the head of the blind-stitching machine such that the fabric bender 3 may approach the path of the arc needle 1 to a distance as necessary for the derived penetration depth in view of the normal thickness of the particular sewing material, when the fabric bender 3 and the support assembly 15 are pivoted in the direction of arrow 8, mutually positioned as shown in FIG. 2. The set depth-of-penetration will be retained even when, during sewing, a thicker sewing material portion, for instance a cross-seam, arrives within the range of the fabric bender 3 because fabric bender 3 then will be pivoted from the position relative to the support assembly 15 shown in FIG. 2 through a corresponding angle toward the position relative to the support assembly 15 shown in FIG. 3 against the force of the torsion spring 25 which has a very level characteristic. This force depends on the bias of torsion spring 25 which bias is matched to the sewing material by correspodingly setting holder 33 of torsion spring 25 relative to the drive shaft 11 of the fabric bender 3.

FIGS. 1 through 3 show the position of the fabric-support arm 5 of the blind-stitching machine relative to its head wherein the two sewing-material feed belts 4 are located in the vicinity of the pressing levers 44 directly against the throat plate 2 and wherein the minimum distance between the fabric bender 3 and the path of the arc needle 1 is zero. The support assembly 15 and the drive shaft 11 of the fabric bender 3 are shown in the position which they assume at the end of pivoting in the direction of the arrow 8 and at the beginning of the pivoting motion in the direction of the arrow 9 respectively.

Figure 4:
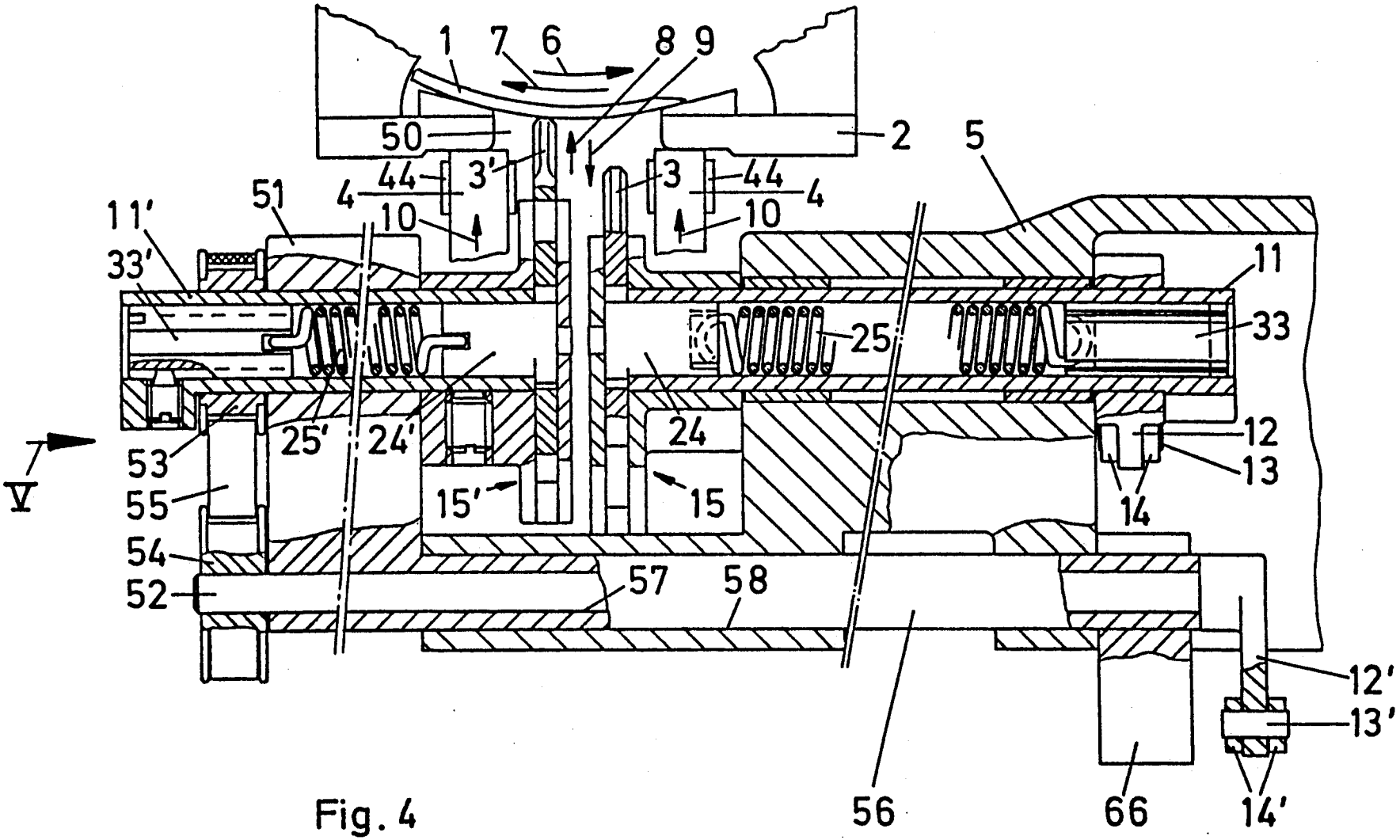
FIG. 4 is the front view similar to that of FIG. 1 of a second embodiment of the blind-stitch sewing machine of the invention with two fabric benders.

Essentially, the blind-stitch sewing machine embodiment depicted in FIGS. 4 and 5 differs from that of FIGS. 1 through 3 only in that a second fabric bender 3' is provided. With respect to design, mounting and operation, second fabric bender 3' is identical to first fabric bender 3 except that the drive shaft 11', support assembly 15', pin 24' and torsion spring 25' of the second fabric bender 3' are mirror-symmetrical in design and in mounting to the drive shaft 11, support assembly 15, pin 24 and torsion spring 25 of the first fabric bender 3. The same applies to holder 33' for the torsion spring 25' of second fabric bender 3' and the holder 33 for torsion spring 25 of first fabric bender 3. The two hollow drive shafts 11 and 11' extend therefore in mutually aligned manner on both sides of fabric benders 3, 3', i.e., each drive shaft 11 or 11' away from support assembly 15 or 15' of associated fabric bender 3 or 3'. During sewing the two fabric benders 3 and 3', which are very tightly mounted next to each other between the two feed belts 4, become alternatingly operational in order to bulge the sewing material into the path of the arc needle 1 of the blind-stitching machine.

The hollow drive shaft 11' of the second fabric bender 3' rests rotatably in a support 51 and is connected by a toothed-belt drive to an additional drive shaft 52 which is mounted parallel to the two hollow drive shafts 11 and 11'. The toothed-belt drive consists of a toothed-belt gear 53 affixed to the hollow drive shaft 11', a toothed-belt gear 54 affixed to the additional drive shaft 52, and an endless toothed belt 55 looping the two toothed-belt gears 53 and 54. The additional drive shaft 52 includes an arm 12' located at the end away from the toothed-belt drive. Arm 12' is linked by a bolt 13' to a bar 14' by means of which the drive shaft 52 can be pivoted through the arm 12' to-and-fro. In this manner the two fabric benders 3 and 3' can be driven from the same side, namely from the side which is on the right in FIG. 4 and which is away from the free end of the fabric-support arm 5.

Support 51 is pivotably carried by fabric-support arm 5 and comprises a hollow pivot shaft 56 located on the side which is remote from the toothed-belt drive and adjacent the pair of fabric benders 3,3'. The additional drive shaft 52 for second fabric bender 3' is rotatably supported in a borehole 57 of hollow pivot shaft 56. Borehole 57 also passes through support 51 and extends transversely thereto. In turn, pivot shaft 56 is rotatably supported in a longitudinal borehole 58 of fabric-support arm 5.

As shown in FIG. 5, fabric-support arm 5 is rotatably supported through a shaft 60 on the housing 59 of the blind-stitching machine and is loaded by a helical tension spring 61 into the sewing position shown. In this position, fabric-support arm 5 rests through a first adjustment screw 62 on the housing 59. Screw 62 is threaded into a downward extension 63 of a forward longitudinal wall 64 of fabric-support arm 5. Shaft 60 is parallel to drive shafts 11, 11' and 52 for the fabric benders 3 and 3' and the helical tension spring 61 acts at one end on the extension 63 and at the other end on the housing 59. Support 51 of the drive shaft 11' for the second fabric bender 3' is pivotable about the common longitudinal axis of the additional drive shaft 52 for the second fabric bender 3' and of its own pivot shaft 56 which is coaxial with the additional drive shaft 52. Support 51 is biased by a helical compression spring 65 bearing at one end against a downward projection 66 of support 51 and at the other end against housing 59 of the blind-stitching machine. Functionally, the other end of helical compression spring 65 could bear against fabric-support arm 5 instead of housing 59. Compression spring 65 biases projection 66 on pivot shaft 56, shown in FIG. 4 next to the arm 12' of the additional drive shaft 52, against a second adjustment screw 67 threaded into the extension 63 of the fabric-support arm 5. Accordingly, the depth of penetration of the arc needle 1 into the sewing material made to bulge by the first fabric bender 3 can be set independently of the depth of penetration of the arc needle 1 into the sewing material made to bulge by the second fabric bender 3', by appropriately setting the fabric-support arm 5 relative to the housing 59 of the blind-stitching machine using the first adjustment screw 62 or the support 51 relative to the fabric-support arm 5 using the second adjustment screw 67, respectively.

It should be recognized that the above description is directed to preferred embodiments of the invention and that various changes/modifications can be made without departing from the spirit of the invention. For instance, it is possible to have the fabric bender 3 or the two fabric benders 3 and 3' cooperate with one stop or with separate stops at the throat plate 2, or to provide the fabric bender 3 or each of fabric benders 3 and 3' with a sewing-material sensor. Further, other material advancing mechanisms may be used in place of the two feed belts 4. Therefore, the invention can be modified within the limitations of the following claims.

I claim:

1. In a blind-stitch sewing machine having a fabric bender assembly including a plate-shaped fabric bender extending in a plane generally perpendicular to the path of an arc sewing needle and being pivotable to-and-fro in this plane by means of a drive shaft extending substantially perpendicular to the plane to cause a material to be sewn to bulge into the arcuate path of the arc needle with the fabric bender being supported in a slot of a support assembly projecting from the drive shaft so as to be pivotable about an axis parallel to the drive shaft, the improvement in said fabric bender assembly comprising:

a borehole formed in said drive shaft such that said drive shaft is hollow, said borehole extending into said slot of the support assembly;

a cylindrical pin rotatably supported in said borehole, said cylindrical pin including a first end extending into said slot and a second end located in said borehole, said first end of said cylindrical pin including a radially projecting cam which engages said fabric bender; and spring means mounted in said borehole of said drive shaft, one end of said spring means being connected to said second end of said cylindrical pin and the other end of said spring means being non-rotatably secured to said drive shaft so that said spring means urges said fabric bender in a direction away from said drive shaft.

2. A blind-stitch sewing machine as claimed in claim 1, wherein said spring means comprises a torsion spring.

3. A blind-stitch sewing machine as claimed in claim 1, wherein the fabric bender includes an aperture receiving said cam of said cylindrical pin, said aperture being formed with a projection which acts as an abutment for said cam and two stop edges which, in conjunction with said cam, define the permissible pivoting range of the fabric bender in said slot.

4. A blind-stitch sewing machine as claimed in claim 1, wherein said support assembly comprises two substantially parallel interconnected plates extending perpendicular to said drive shaft, one of said plates being mounted on an adjacent end of said drive shaft.

5. A blind-stitch sewing machine as claimed in claim 4, wherein said two plates are interconnected by a plurality of spaced bolts, said fabric bender being pivotally mounted on one of said bolts.

6. A blind-stitch sewing machine as claimed in claim 5, wherein said two plates are triangular and are connected together at each apex of the triangle by a respective one of said bolts, said plates also being substantially concentric with said drive shaft.

7. A blind-stitch sewing machine as claimed in claim 5, wherein said bolt upon which said fabric bender is pivotally mounted extends on a side of said drive shaft which faces the path of said arc needle.

8. A blind-stitch sewing machine as claimed in claim 2, further comprising:

a cylindrical holder rotatably located inside said borehole of the drive shaft, said other end of said torsion spring being non-rotatably secured to said cylindrical holder whereby rotation of said cylindrical holder causes biasing of the torsion spring; and means for non-rotatably locking said cylindrical holder to said drive shaft in a plurality of different rotational positions.

9. A blind-stitch sewing machine as claimed in claim 8, wherein said holder comprises a plurality of circumferentially equidistant longitudinal grooves and a radial clamping screw is provided which is adapted to extend through said drive shaft and into one of said grooves.

10. A blind-stitch sewing machine as claimed in claim 8, wherein said torsion spring comprises a helical spring having ends extending transverse to the longitudinal axis of the helical spring, said second end of said cylindrical pin including a tranverse slot into which one end of said spring is secured, and said holder also including a slot formed in one end thereof into which the other end of said spring is non-rotatably secured.

11. A blind stitch sewing machine as claimed in claim 1, wherein said material to be sewn is advanced by means of a pair of spaced, driven feed belts and wherein said fabric bender is mounted between said feed belts.

12. A blind-stitch sewing machine as claimed in claim 1, further comprising a second fabric bender assembly mounted in mirror-symmetry to said fabric bender assembly.

13. A blind-stitch sewing machine as claimed in claim 12, further comprising input drive means for rotating said drive shafts, said input drive means including a first drive member connected to the drive shaft of the first fabric bender assembly and a second drive member connected to the drive shaft of the second fabric bender assembly through an additional drive shaft extending substantially parallel to and offset from said drive shafts, said additional drive shaft being connected by a toothed-belt drive to the drive shaft of the second fabric bender assembly.

14. A blind-stitch sewing machine as claimed in claim 12, wherein said drive shafts are rotatably supported in a fabric-support arm, said sewing machine further comprising means for adjusting the fabric-support arm relative to the path of the arc needle in order to set the depth of penetration of the arc needle into the sewing material.

15. A blind-stitch sewing machine as claimed in claim 14, including means for spring loading said fabric-support arm into a sewing position and an adjustment screw for holding said fabric-support arm in said sewing position.

16. A blind-stitch sewing machine as claimed in claim 14, wherein, in order to separately set the depth of penetration of the arc needle into the material bulged by either the first or second fabric bender assembly, one of said drive shafts is rotatably mounted in a support which is adjustable on the fabric-support arm relative to the path of the arc needle.

17. A blind-stitch sewing machine as defined in claim 16, further including means for spring loading said support into a sewing position on said fabric-support arm and an adjustment screw for holding said support in said sewing position.

18. A blind-stitch sewing machine as claimed in claim 1, wherein said drive shaft is rotatably supported in a fabric-support arm, said sewing machine further comprising means for adjusting the fabric support arm relative to the path of the arc needle in order to set the depth of penetration of the arc needle into the sewing material.

19. A blind-stitch sewing machine as claimed in claim 18, including means for spring loading said fabric-support arm into a sewing position and an adjustment screw for holding said fabric-support arm in said sewing position.

20. A blind-stitch sewing machine as claimed in claim 16, further comprising input drive means for rotating said drive shafts, said input drive means including a first drive member connected to the drive shaft of the first fabric bender assembly and a second drive member connected to the drive shaft of the second fabric bender assembly through an additional drive shaft extending substantially parallel to the offset from said drive shafts, said additional drive shaft being connected by a toothed-belt drive to the drive shaft of the second fabric bender assembly, wherein said drive shaft of the second fabric bender assembly is rotatably supported in said support which is pivotably mounted on said fabric-support arm by means of a pivot shaft extending coaxially to said additional drive shaft.

21. A blind-stitch sewing machine as claimed in claim 12, wherein said material to be sewn is advanced by means of a pair of spaced, driven feed belts and wherein both fabric benders of said first and second fabric bender assemblies are mounted between said feed belts.

* * * * *